US005393043A

United States Patent [19]

Nitta

[11] Patent Number: 5,393,043

[45] Date of Patent: Feb. 28, 1995

[54] IMAGE FORMING APPARATUS WITH AUTOMATIC PAPER SUPPLY MECHANISM

[75] Inventor: Horoshi Nitta, Atsugi, Japan

[73] Assignee: Ricoh Company, Ltd., Tokyo, Japan

[21] Appl. No.: 2,069

[22] Filed: Jan. 8, 1993

[30] Foreign Application Priority Data

Jan. 10, 1992 [JP] Japan ..... 4-002513

[51] Int. Cl.[6] ..... B65H 3/44

[52] U.S. Cl. ..... 271/9; 271/259; 355/208; 355/313

[58] Field of Search ..... 271/9, 259, 265; 355/208, 313, 321

[56] References Cited

FOREIGN PATENT DOCUMENTS

| | | | |
|---|---|---|---|
| 0035715 | 3/1980 | Japan | 271/9 |
| 0181651 | 7/1989 | Japan | 271/9 |
| 0075551 | 3/1990 | Japan | 271/9 |
| 0249836 | 10/1990 | Japan | 271/9 |

*Primary Examiner*—H. Grant Skaggs
*Assistant Examiner*—Carol L. Druzbick
*Attorney, Agent, or Firm*—Oblon, Spivak, McClelland, Maier & Neustadt

[57] ABSTRACT

An image forming apparatus is coupled to a paper supply mechanism formed of a plurality of paper supply units storing papers, the plurality of paper supply units being arranged in a predetermined order along a paper feed path and papers being ejected one by one from each of the plurality of paper supply units to the paper feed path, the papers being fed to the image forming apparatus so that images are formed on the papers. The image forming apparatus includes a jam detecting sensor for detecting whether or not a paper jam occurs in the paper feed path while papers are being supplied, one by one, from each of the plurality of paper supply units, and a paper supply controller for, when the jam detecting sensor detects that a paper jam occurs, substituting a paper supply unit positioned at a position further downstream from a position at which the paper jam has occurred for an original paper supply unit that has supplied to the paper feed path the paper that has jammed, so that papers are continuously supplied from the substitute paper supply unit to the image forming apparatus via the paper feed path.

4 Claims, 10 Drawing Sheets

| S1 | 0 | 0 | 1 | 1 |
|---|---|---|---|---|
| S2 | 0 | 1 | 0 | 1 |
| STATE | B4 | A4 | A3 | DETACHED |

IMAGE FORMING APPARATUS WITH AUTOMATIC PAPER SUPPLY MECHANISM

BACKGROUND OF THE INVENTION (1) Field of the Invention

The present invention generally relates to an image forming apparatus with an automatic paper supply mechanism, and more particularly to an image forming apparatus with an automatic paper supply mechanism formed of a plurality of paper supply units for supplying papers having various sizes. The image forming apparatus forms image information on a paper selectively supplied from the paper supply units.

(2) Description of Related Art

Recently, facsimile machines, printers, copy machines and other image forming apparatuses have been widely used. Many facsimile machines and printers are provided with automatic paper mechanisms so that it is easy to supply documents and recording papers.

In a conventional image forming apparatus with an automatic paper supply mechanism, paper supply units are detachably provided in a housing, and an optional paper supply mechanism is mounted on the bottom of the housing. The optional paper supply mechanism is detachably provided with a plurality of paper supply units for supplying different size papers. A paper feed path coupled to the respective paper supply units is formed in the optional paper supply mechanism so as to be coupled to a paper feed path in the image forming apparatus. When a user inputs an instruction for selecting a paper size, papers are ejected, one by one, from a paper supply unit corresponding to the selected paper size to the paper feed path and are fed to the image forming apparatus through the paper feed path. The image forming apparatus then forms images corresponding to input image information on the papers supplied from the optional paper supply mechanism.

In the above image forming apparatus provided with the optical paper supply mechanism, when a paper jam occurs in the paper feed path in the optional paper supply mechanism, papers cannot be supplied from any of the paper supply units. That is, the image forming operation in the image forming apparatus is interrupted. Thus, after the jammed paper is removed from the paper feed path in the optional paper supply mechanism, the user must carry out an operation for restarting the image forming operation.

In the optional paper supply mechanism, positions at which papers are ejected from the respective paper supply units to the paper feed path differ from each other. Thus, even if a paper jam occurs in the paper feed path, papers can be supplied to the image forming apparatus via the paper feed path from paper supply units positioned upstream side of a point at which the paper jam occurs. However, in the conventional apparatus, when the paper jam occurs, the image forming operation is always interrupted and the jammed paper must be removed from the paper feed path. Thus, a long time is required for the image forming operation with respect to the required number of papers is completed.

SUMMARY OF THE INVENTION

Accordingly, a general object of the present invention is to provide a novel and useful image forming apparatus with an automatic paper supply mechanism in which apparatus the disadvantages of the aforementioned prior art are eliminated.

A more specific object of the present invention is to provide an image forming apparatus with an automatic paper supply mechanism in which even if a paper jam occurs the image forming operation can be effectively performed.

The above objects of the present invention are achieved by an image forming apparatus coupled to a paper supply mechanism formed of a plurality of paper supply units storing papers, the plurality of paper supply units being arranged in a predetermined order along a paper feed path, and papers being ejected, one by one, from each unit of the plurality of paper supply units to the paper feed path leading to the image forming apparatus so that images are formed on the papers, the image forming apparatus comprising: jam detecting means for detecting whether or not a paper jam has occurred in the paper feed path while papers are being supplied, one by one, from each of the plurality of paper supply units; and paper supply control means for, when the jam detecting means detects that a paper jam occurs, substituting a paper supply unit positioned at a position downstream from a position at which the paper jam has occurred for an original paper supply unit that has supplied the jammed paper to the paper feed path, so that papers are continuously supplied from the substitute paper supply unit to the image forming apparatus via the paper feed path.

According to the present invention, even if a paper jam occurs, papers can be continuously supplied from the substitutive paper supply unit positioned downstream from a position at which the paper jam occurs. Thus, when a paper jam occurs, the printing operation in the image forming apparatus can be prevented from being interrupted by the paper jam. The printing operation can thus be effectively performed.

Additional objects, features and advantages of the present invention will become apparent from the following detailed description when read in conjunction with the accompanying drawings.

DESCRIPTION OF THE PREFERRED EMBODIMENTS

A description will now be given, with reference to the drawings, of an embodiment of the present invention.

Figure 1:
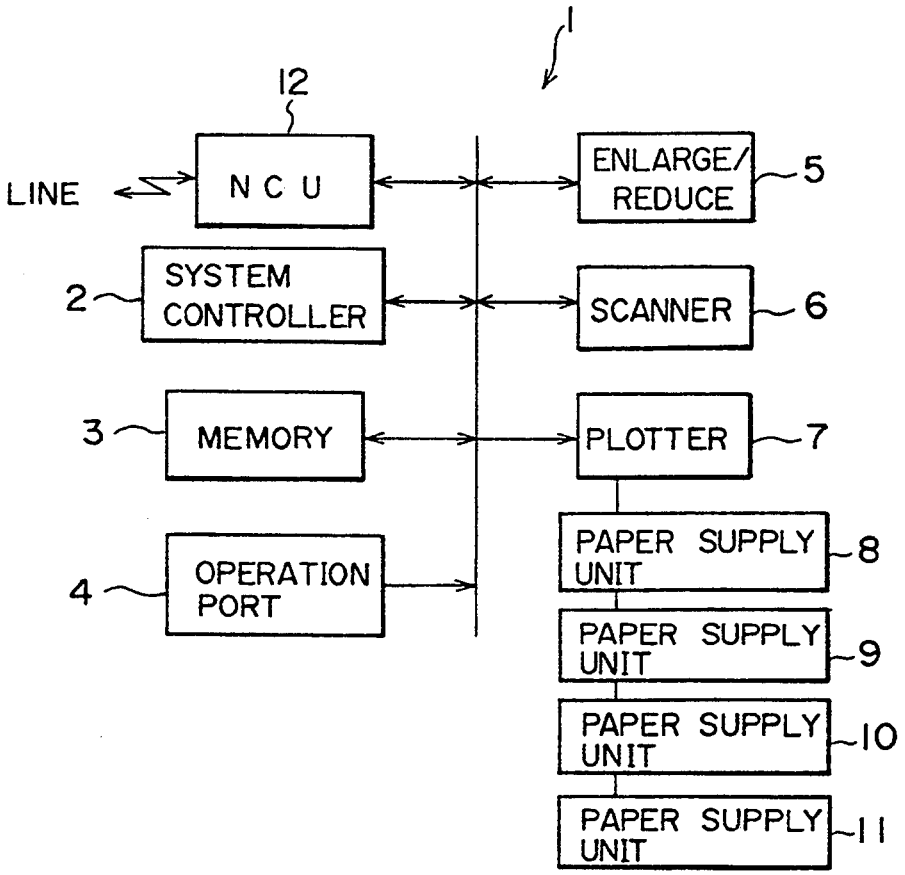
FIG. 1 is a block diagram illustrating a facsimile machine with an automatic paper supply mechanism according to an embodiment of the present invention.

FIG. 1 shows constitution of a facsimile machine. Referring to FIG. 1, the facsimile machine 1 comprises a system controller 2, a memory 3, an operation port 4, an enlarge/reduce processor 5, a scanner 6, a plotter 7, paper supply units 8–11 and a network control unit (NCU) 12.

The system controller 2 controls respective parts of the facsimile machine 1 in accordance with programs stored in the memory 3. The system controller 2 also carries out a paper supply process in accordance with a predetermined program stored in the memory 3. The memory 3 stores various programs including the program for performing the paper supply process and has an area on which image data is to be temporarily stored. The operation port 4 has ten keys, various operation keys such as a start key and a display panel (e.g. a liquid crystal display panel). Due to operations of keys of the operation port 4, various instructions including a transmitting instruction and the like are input to the facsimile machine 1. A size of each of papers stored in the paper supply units 8–11 can be selected by key operations of the operation port 4. Instructions input by the key operations of the operation port 4 and information generated in the facsimile machine 1 are displayed on the display panel. The enlarge/reduce processor 5 enlarges or reduces image data at a magnification indicated by a key operation of the operation port 4. The scanner 6 is provided with a CCD (Carge Coupled Device) sensor. The scanner 6 optically scans documents and reads images on the documents.

Figure 2:
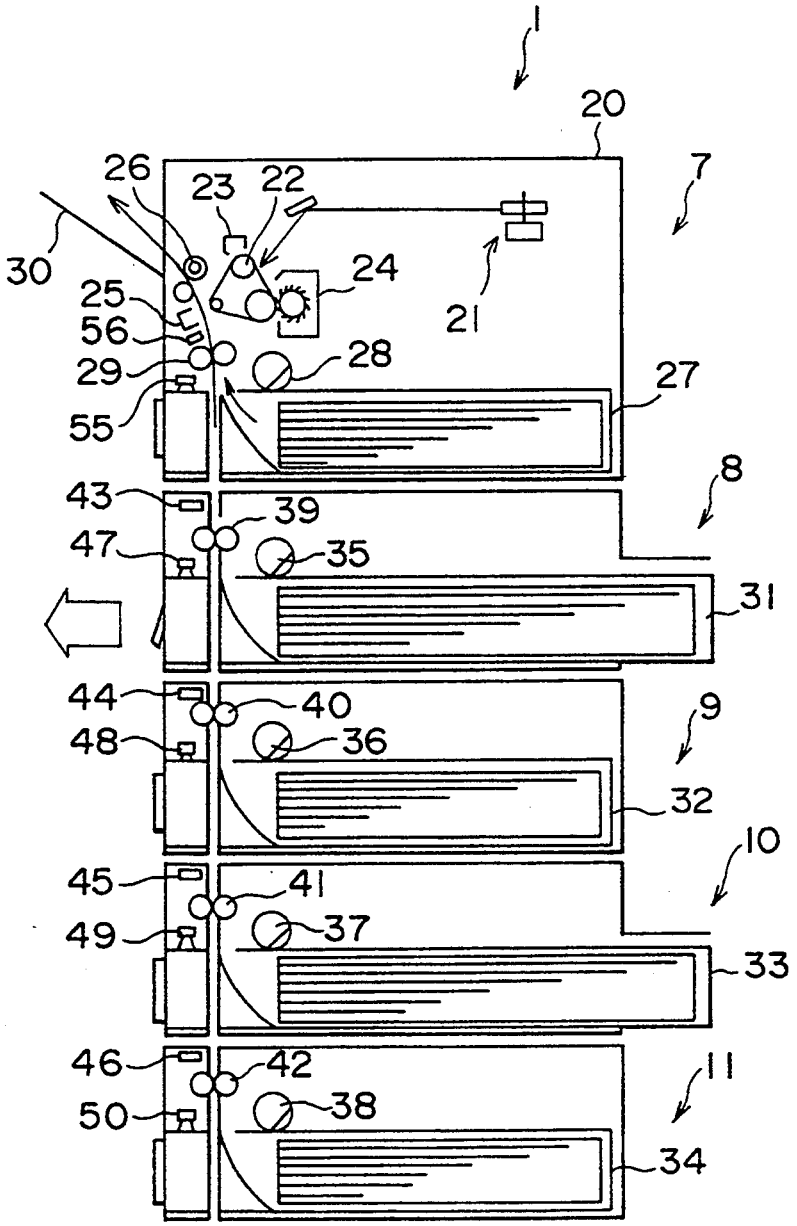
FIG. 2 is a diagram illustrating a plotter and a paper supply mechanism provided in the facsimile machine.

The plotter 7 and the paper supply units 8–11 are formed as shown in FIG. 2. Referring to FIG. 2, the plotter 7 is mounted in a housing 20 of the facsimile machine 1, and the paper supply units 8–11 are mounted on the bottom of the housing 20. The plotter 7 comprises an optical writing unit 21, a photosensitive medium 22, a precharger unit 23, a developing unit 24, a transfer unit 25, a fixing unit 26, a paper cartridge 27, a pick-up roller 28 and feed rollers 29 and the like. The plotter 7 forms images in accordance with an electrophotographic process. The optical writing unit 21 emits a light beam mounted in accordance with image data. The right beam emitted by the optical writing unit 21 is projected onto the photosensitive medium 22 charged by the precharger unit 23 and moved at a constant speed. Due to the projection of the light beam, an electrostatic latent image is formed on the photosensitive medium 22, and the electrostatic latent image is developed by the developing unit 24 so that a toner image corresponding to the electrostatic latent image is formed on the photosensitive medium 22. A paper is ejected from the paper cartridge 27 by the pick-up roller 28 and is fed toward the photosensitive medium 22 by the feed rollers 29. The toner image is transferred by the transfer unit 25 from the photosensitive medium 22 to the paper supplied from the paper cartridge 27. After the toner image is fixed on the paper by the fixing unit 26, the paper is ejected to a tray 30.

Figure 3:
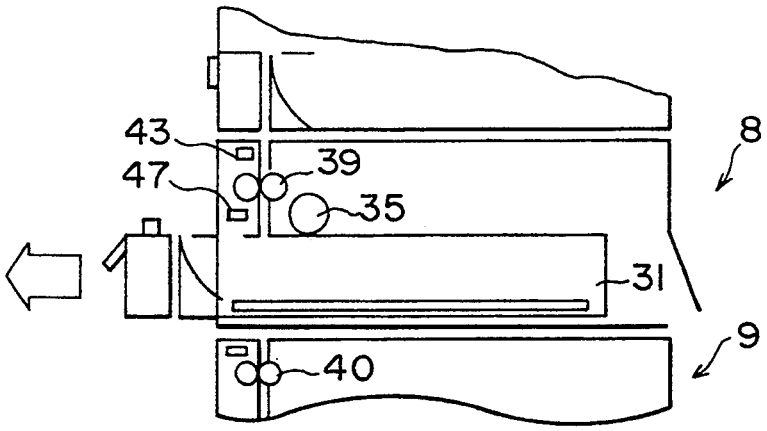
FIG. 3 is a diagram illustrating a cartridge sensor for detecting the width of a paper stacked in a paper cartridge is mounted.

The paper supply units 8–11 are respectively provided with paper cartridges 31–34 for storing papers, pick-up rollers 35–38 for separating papers in the paper cartridges 31–34 one by one and ejected therefrom, feed rollers 39–42 for feeding papers, ejected from the paper cartridges, toward the plotter 7 through a paper feed path, registration sensors 43–46 for detecting paper jams in the paper feed path and cartridge sensors 47–50 for detecting sizes of the papers stored in the paper cartridges 31–34. Each of the paper cartridges 31–34 can be detached from a corresponding one of the paper supply units 8–11 in a direction shown by an arrow in FIG. 2. After each of the paper cartridges 31–34 is removed from a corresponding one of the paper supply units 8–11 as shown in FIG. 3, papers are supplied to it. The paper cartridge 27 mounted in the housing 20 of the plotter 7 is also removed from the housing 20, and the papers are resupplied to it.

Each of the cartridge sensors 47–50 detects the size of papers stored in a corresponding one of the paper cartridges 31–34 as follows.

Figure 4:
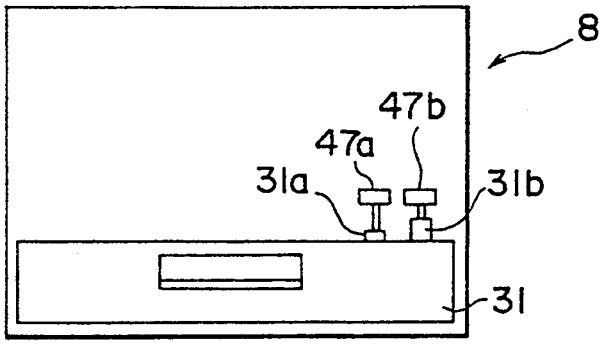
FIG. 4 is a diagram illustrating a paper cartridge detached from a housing of the automatic paper supply mechanism.
Figure 5A:
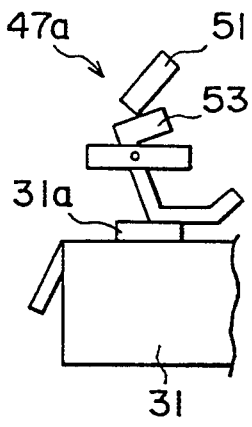
FIGS. 5A and 5B are diagrams illustrating operations of the cartridge sensor.
Figure 5B:
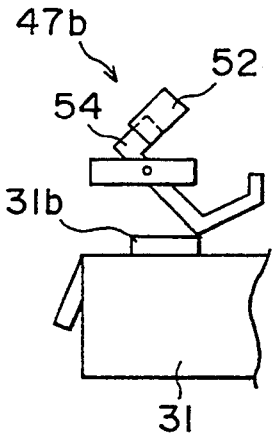
Figure 6:
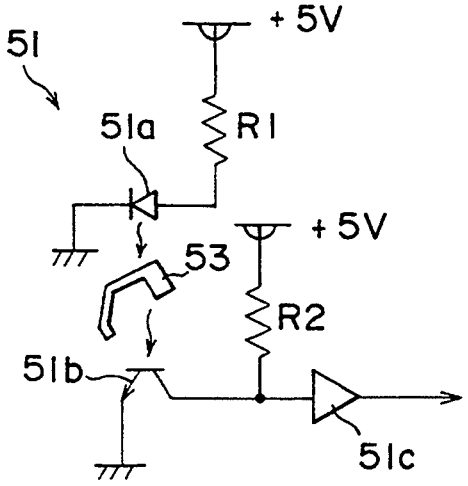
FIG. 6 is a circuit diagram illustrating a circuit of the cartridge sensor.
Figures 7, 8:
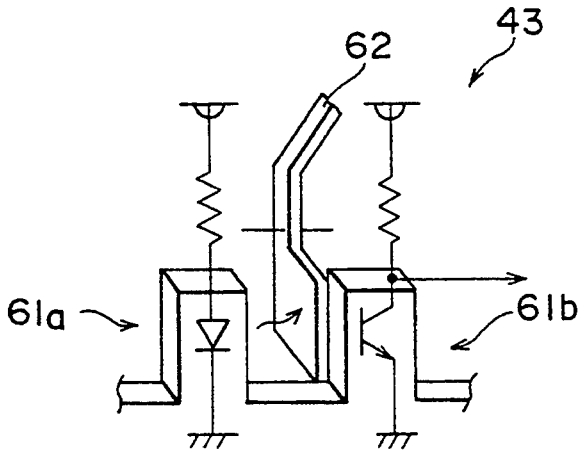
FIG. 7 is a table illustrating relationships between states of a detection signal output from the cartridge sensor and detecting results.
FIG. 8 is a diagram illustrating a structure of a registration sensor.

FIG. 4 shows, for example, the paper cartridge 31 in the paper supply unit 8. The cartridge sensor 47 is formed of a first sensor 47*a* (S1) and a second sensor 47*b* (S2). A first boss 31*a* and a second boss 31*b* are mounted on the top plate of the paper cartridge 31. The combination of heights of the first and second bosses 31*a* and 31*b* depends on the size of papers stored in the paper cartridge 31. The first sensor 47*a* and the second sensor 47*b* are arranged so as to detect the first boss 31*a* and the second boss 31*b* respectively. The first sensor 47*a* is formed of a photo-sensor 51 and a photo-interrupter 53 as shown in FIG. 5A. When the first boss 31*a* is not in contact with the photo-interrupter 53, the photo-interrupter 53 interrupts a light of the photo-sensor 51. When the first boss 31*a* is in contact with the the photo-interrupter 53, the photo-interrupter 53 does not interrupt the light of the photo-sensor 51. The photo-sensor 51 is formed of an LED 51*a* and a photo-transistor 51*b*, and is connected to a detecting circuit as shown in FIG. 6. In the detecting circuit, when the photo-interrupter 53 interrupts the light between the LED 51*a* and photo-transistor 51*b*, a detecting signal output from a buffer 51*c* in the detecting circuit is activated "1". On the other hand, when the photo-interrupter 53 does not interrupt the light between the LED 51*a* and the photo-transistor 51*b*, the detecting signal output from the buffer 51*c* is inactive "0". The second sensor 47*b* has a photo-sensor 52 and a photo-interrupter 54 as shown in FIG. 5B. The second sensor 47 is coupled to a detecting circuit having the same structure as that shown in FIG. 6, and operates in the same manner as the first sensor 47*b*. The size of the papers stored in the paper cartridge 31 is detected based on the combination of the detecting signals from the first and second sensors 47*a* (S1) and 47*b* (S2) as shown in FIG. 7. It is also detected, by means of the combination of the detecting signals from the first and second sensors 47*a* (S1) and 47*b* (S2) as shown in FIG. 7, whether or not the paper cartridge 31 is mounted in the paper supply unit 8.

Figure 9A:
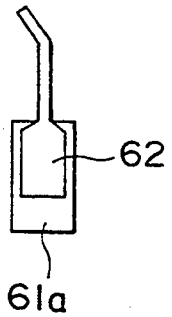
FIGS. 9A and 9B are diagrams illustrating operations of the registration sensor.
Figure 9B:
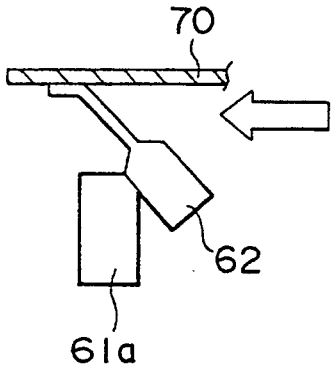

Each of the registration sensors 43–46 is formed as shown in FIG. 8. FIG. 8 shows the registration sensor 43 provided in the paper supply unit 8. The registration sensor 43 is formed of an LED 61*a*, a photo-transistor 61*b* and a photo-interrupter 62. The photo-interrupter 62 is arranged in a paper feed path so that a paper 70 fed through the paper feed path pushes an end of the photo-interrupter 62 and the photo-interrupter 62 then interrupts a light between the LED 61*a* and the photo-transistor 61*b*. When the photo-interrupter 62 interrupts the light between the LED 61*a* and the photo-transistor 61*b* as shown in FIG. 9A, a detecting signal is inactivated "0". On the other hand, when the photo-interrupter 62 does not interrupt the light between the LED 61*a* and the photo-transistor 61*b* as shown in FIG. 9B, the detecting signal is activated "1".

The plotter 7 is provided with a cartridge sensor 55 for detecting the size of the papers stored in the paper cartridge 27 and with a registration sensor 56 for detecting whether or not a paper is fed through the paper path.

The paper cartridge 27 is mounted in the housing of the plotter 7, and the paper supply units 8–11 are mounted on the bottom of the housing 20 of the plotter 7 so that the paper supply units 8–11 are respectively stacked in a vertical direction. In this state, a paper path is formed from the paper supply unit 11 positioned at the lowest position to the photosensitive medium 22 in the plotter 7.

Returning to FIG. 1, the NCU 12 includes a modem and other communication devices and is connected with a line (e.g. a telephone line). The NCU 12 sets and removes a call, and automatically carries out a calling-/called operations. The modem in the NCU 12 modulates transmission signals and demodulates received signals. The NCU 12 outputs control signals so that facsimile communication between this facsimile machine and another station is controlled.

In this embodiment, even if a paper jam occurs in the paper feed path under a condition in which papers are being fed one by one from one of the paper supply units 8–11, papers can be continuously supplied from another paper supply unit without interrupting the printing operation.

In FIG. 2, A4 sized papers are stored in the paper cartridges 27, 32 and 34, and B4 sized papers are stored in the paper cartridges 31 and 33. The paper path extending from the paper supply unit 11 positioned at a lowest position in the paper feed stream to the photosensitive medium 22 in the housing 20 of the plotter 7 is divided into five sections A–E. In each of the sections A–E, a time required for a paper to pass through each registration sensor is calculated based on a feeding speed of the paper. This required time is referred to as a reference time. The system controller 2 compares a time for which each registration sensor detects, with the reference time, and determines, based on the comparison result, whether or not a paper jam has occurred in each section. In addition, when a level of a detecting signal from a registration sensor does not change for a predetermined time, it is determined that a paper jam occurs in a corresponding section.

When a user inputs an instruction for selecting a paper size, papers are ejected to the paper feed path, one by one, from a paper cartridge storing papers having the selected paper size. Then, the papers are fed to the photosensitive medium 22 in the plotter 7 via the paper feed path and images are successively formed on the papers.

Figure 10:
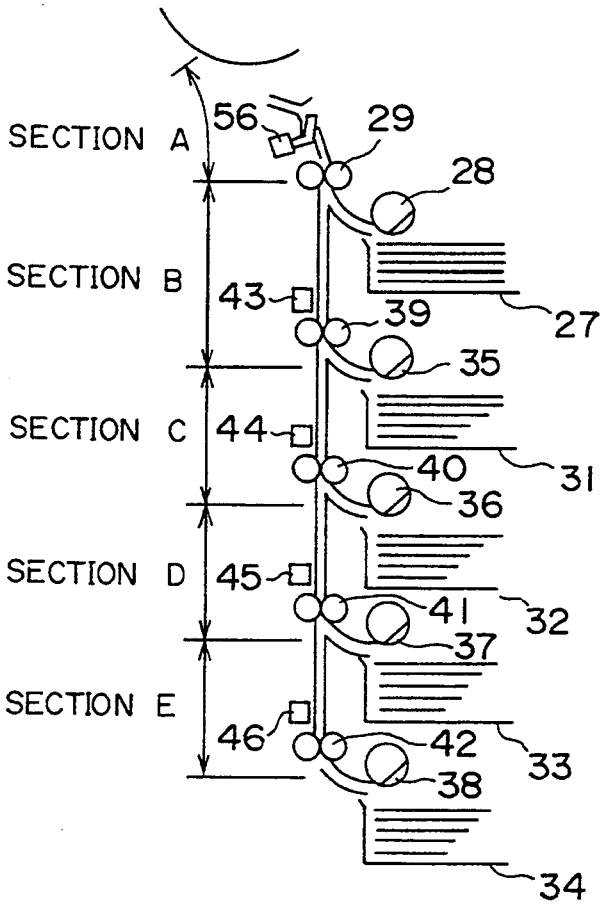
FIG. 10 is a diagram illustrating paper feed paths corresponding to respective paper supply units.

If a paper jam occurs in a position further downstream in the paper feed path, papers cannot be supplied from the large number of paper cartridges positioned upstream from a position at which the paper jam occurs. In FIG. 10, if a paper jam occurs in the section A, papers are supplied from none of the paper cartridges 27, 31, 32, 33 and 34. Thus, a paper cartridge positioned at a position upstream in the paper feed path is preferentially selected from among paper cartridges storing papers having the selected size. That is, a paper cartridge positioned at the lower position in the paper path is preferentially selected. For example, when the user inputs an instruction for selecting B4 size, the B4 sized paper is supplied from the paper cartridge 33 (the paper supply unit 10) positioned at a position lower than the paper cartridge 31 (the paper supply unit 8), and for example, when the user inputs an instruction for selecting A4 size, the A4 sized paper is supplied from the paper cartridge 34 (the paper supply unit 11) positioned at a position lower than the paper cartridges 27 and 32. In this case, even if a paper jam occurs at a position upstream in the paper feed path, papers can be supplied from a paper supply cartridge positioned downstream from a position at which the paper jam has occurred. In FIG. 10, even if a paper jam occurs in the section E, papers can be supplied from the paper cartridges 27, 31, 32 and 33.

In this system, when a paper jam occurs, the paper cartridge is exchanged to another paper cartridge storing the same sized papers, which other paper cartridge is positioned further downstream in the paper feed path. Then the same sized papers are continuously supplied from the other paper cartridge. Hereinafter, this operation is referred to as a recovery operation. For example, when a paper jam of the B4 sized paper supplied from the paper cartridge 33 occurs, the paper cartridge 33 is replaced by the paper cartridge 31 positioned downstream from the section D and B4 papers are supplied from the paper cartridge 31.

In addition, when a paper cartridge become empty, the paper cartridge is replaced by another paper cartridge storing the same sized papers, and the paper is continuously supplied from the other paper cartridge. If a paper cartridge positioned downstream becomes empty before a paper cartridge positioned upstream becomes empty, a probability that the above recovery operation can be performed is decreased. Thus, in this system, paper cartridges are successively exchanged from the upper stream side every time each paper cartridge becomes empty. For example, the B4 sized papers are successively supplied from the paper cartridges 33 and 31 in this order, and the A4 sized papers are successively supplied from the paper cartridge 34, 32 and 27 in this order. In FIG. 10, even if the paper cartridge 32 is empty, when a paper jam occurs in section C4, the papers can be continuously supplied from the cartridge 27 (the recovery operation).

In a facsimile machine, when an image of a B4 size is received, B4 sized papers are supplied to the photosensitive medium 22. When a paper jam of the B4 sized paper occurs in the section B, B4 sized paper can not be supplied from either the paper cartridge 31 or 33. In this case, the received image is temporarily stored in the memory 3. Then, the received image is reduced by the enlarge/reduce processor 5 so as to be in A4 size, and A4 sized papers are supplied from the paper cartridge 27 in the plotter 7. As a result, an image reduced from the B4 size to the A4 size is formed on the A4 sized paper. After the paper jam is removed, the B4 papers are supplied from the paper cartridge 33 and the remaining image stored in the memory 3 is formed on the B4 images without being reduced.

Figure 11:
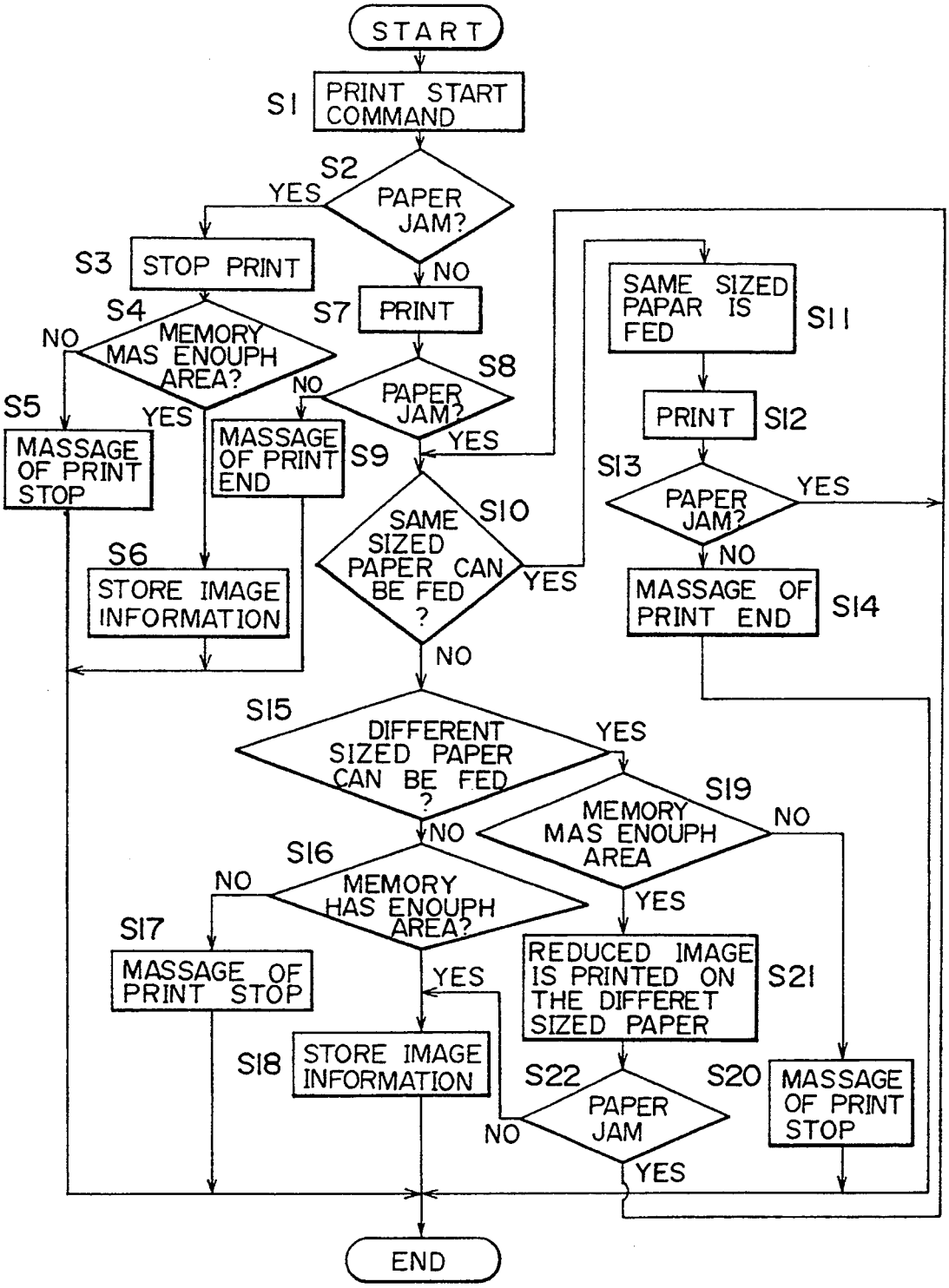
FIG. 11 is a flow chart illustrating a process for printing images stored in a memory.

In the facsimile, images are formed on papers in accordance with a procedure as shown in FIG. 11.

Referring to FIG. 11, when the NCU 12 receives image information, the system controller 2 supplies a print start command to the plotter 7 (in step S1). The controller 2 determines whether or not a paper jam occurs in the section A based on the detecting signal from the registration sensor 56 (in step S2). When it is determined that the paper jam occurs in the section A, the printing operation is interrupted (in step S3). After that, the system controller 2 determines whether or not the memory 3 has an area enough to store the received image information (in step S4). When the memory 3 does not have an area enough to store the received image information, a message indicating the printing operation can not be performed is supplied from the system controller 2 to the operation port 4, and the message is displayed on the display panel of the operation port 4 (in step S5). When it is determined that the memory 3 has an area enough to store the received image information (in step S4), the received image information is stored in the memory 3 (in step S6).

On the other hand, when the system controller 2 determines that a paper jam has not occurred in the section A (in step S2), the printing operation starts in accordance with the print start command from the system controller 2 (in step S7). In this printing operation, a paper cartridge positioned at a position upstream in the paper feed path is selected from among paper cartridges storing. papers having a paper size corresponding to that of the received image information. Papers are then ejected, one by one, from the selected paper cartridge to the paper feed path and are fed to the photosensitive medium 22 in the plotter 7 via the paper feed path. While the printing operation is being performed, the system controller 2 determines whether or not a paper jam has occurred in the paper feed path based on the detecting signals supplied from the registration sensors 56, 43, 44, 45 and 46 (in step S8). When a paper jam has not occurred until the printing operation ends, the system controller 2 supplies a message to the operation port 4 (step S9) indicating the printing operation normally ends. The message is then displayed on the display panel of the operation port 4.

When a paper jam occurs in the printing operation, the system controller 2 determines that another paper cartridge can supply the same sized paper as the jammed paper to the photosensitive medium 22 in the plotter 7 (in step S10). If another paper cartridge can supply the same sized papers as the jammed paper to the photosensitive medium 22 in the plotter 7, the other paper cartridge which can supply the same sized paper as the jammed paper is substituted for the paper cartridge previously selected (in step S11). Papers are then supplied, one by one, from the other paper cartridge and the printing operation is continued (in step S12). While the printing operation is being continuously performed, the controller 2 determines, based on the detecting signals from the registration sensors 56, 43, 44, 45 and 46, whether or not a paper jam has occurred in the paper feed path (in step S13). When the system controller 2 determines that a paper jam has occurred, the process returns to step S10. When the paper jam has not occurred until the printing operation ends, the system controller 2 supplies the message to the operation port 4 (in step S14) indicating that the printing operation has ended normally. The message is then displayed on the display panel of the operation port 4.

On the other hand, when the system controller 2 determines that there is no paper cartridge which can supply the same sized papers as the jammed paper (in step S10), the system controller 2 determines whether or not another paper cartridge can supply papers having a size different from that of the jammed paper (in step S15). When there is no paper cartridge which can supply paper having a size different from that of the jammed paper, the system controller 2 determines whether or not the memory 3 has an area enough to store the received image information (in step S16). Then, when the memory 3 does not have an area enough to store the received image information, the controller 2 supplies the message indicating the printing operation has ended to the operation port 4 (in step S17). The message is displayed on the display panel of the operation port 4. When the system controller 2 determines that the memory 3 has an area enough to store the received image information, the received information is stored in the memory 3 (in step S18).

When it is determined that another paper cartridge can supply papers having a size different from that of the jammed paper in step S15, the system controller 2 determines whether or not the memory 3 has an area enough to store the received image information (in step S19). When the memory 3 does not have an area enough to store the received image information, the message indicating the printing operation has ended is displayed on the display panel of the operation port 4 (in step S20). On the other hand, when the memory 3 has an area enough to store the received image information, the size of the received image information is changed by the enlarge/reduce processor 5 so as to correspond to the size of the paper stored in the another paper cartridge determined in step S15 (in step S21). The image information whose size is changed is formed on the papers supplied from the another paper cartridge. While the printing operation is being performed, the system controller 2 determines whether or not a paper jam has occurred in the paper feed path (in step S22). When a paper jam has not occurred, the received image information is stored in the memory 3 (in step S18). When a paper jam has occurred in the paper feed path, the process returns to step S10. after that, the process is repeatedly performed in the same manner as that described above.

According to the above printing operation, even if a paper jam occurs, either papers having the same size as the jammed paper or papers having a size different from that of the jammed paper can be continuously supplied to the photosensitive medium 22 in the plotter 7. In a case where the image is formed on the papers having the size different from that of the jammed paper, if the paper jam is removed, the same sized papers as the jammed paper are supplied again and the image is formed on the paper.

The paper supply units 8–11 are serially connected to the plotter 7 as shown in FIG. 1. Thus, the number of paper supply units can be either increased or decreased without changing the number of interface circuits to be provided in the plotter 7.

Papers are supplied, at a high speed, from a multi paper supply equipment having a plurality of paper supply units as follows.

Figure 12:
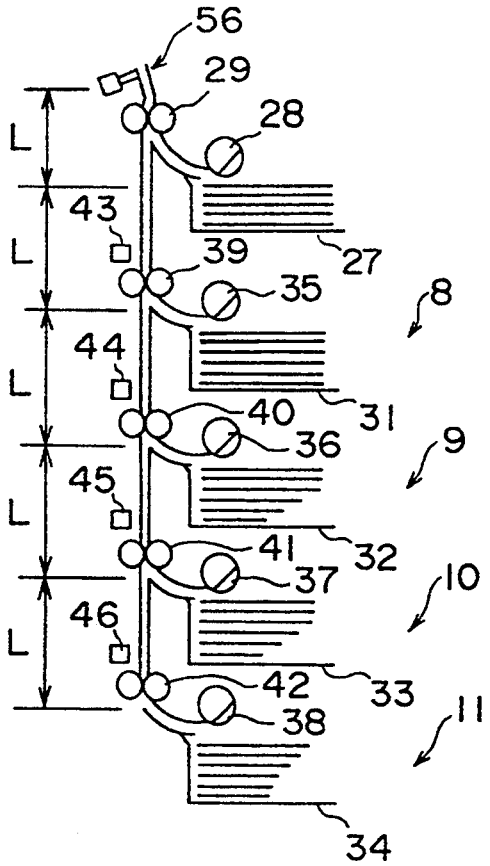
FIG. 12 is a diagram illustrating feeding path lengths for papers stored in respective paper supply units.

FIG. 12 shows a multi paper supply equipment having five paper supply units 8–11 in the same manner as that shown in FIG. 2. The paper supply units 8–11 are stacked so as to be arranged at intervals (L). If it is assumed that papers are supplied from the paper cartridge 27 in the plotter 7 at a speed V, it takes a time of L/V for the paper to reach the registration sensor 56 provided immediately upstream of the photosensitive medium 22. Thus, to feed papers from the paper supply units 8–11 to the registration sensor 56 in the same time (L/V) as the paper cartridge 27, the paper from the paper supply units 8–11 may be respectively fed at speeds of 2 V, 3 V, 4 V and 5 V.

The plotter 7 and the paper supply units 8–11 are provided with feed motors in which a rotating direction can be changed and the rotational speed can be controlled. A clutch is coupled to the pick-up roller 28. In a process carried out by the system controller 2, the paper supply units 8–11 connected to the plotter 7 are respectively identified by addresses 1, 2, 3 and 4. The system controller 2 controls the rotational speed and the rotating direction of the feed motor provided in the plotter 7 and controls the on and off operation of the clutch coupled to the pick-up roller 28. A motor control signal for the feed motor in the plotter 7 is formed of four bits; one bit for the on and off control of the feed motor, one bit for representing the rotation direction and two bits used for setting a rotational speed.

When papers are supplied from the paper supply unit 8 identified by the address 1, a feed motor identified by the address 1 is driven at a speed of 2 V, and the feed motor in the plotter 7 is also driven at the same speed of 2 V. At this time, feed motors identified by the addresses 2, 3 and 4 are stopped. When papers are supplied from the paper supply unit 11 identified by the address 4, all the feed motors identified by the addresses 1–4 and in the plotter 7 are driven at the speed of 5 V. In this case, after the paper is detected by each of the registration sensors 43–46 and 56, a corresponding feed motor is stopped.

Actually, papers must be separately ejected, one by one, from each of the paper cartridges 27 and 31–34. The papers are ejected from each paper cartridge at, for example, a speed of V. Then, the speed at which the papers are fed is gradually increased. In a case where papers are supplied from the paper supply unit 11 positioned the upper stream in the paper feed path, the highest speed at which the papers are fed through the paper feed path is set, for example, to 6 V.

Figure 13:
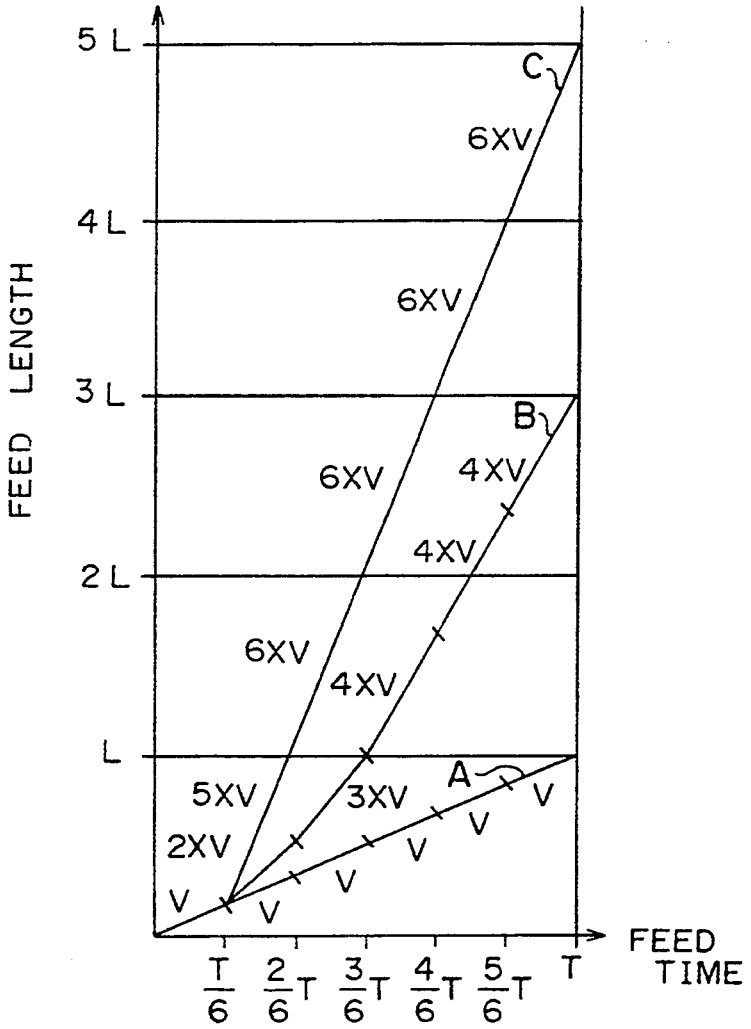
FIG. 13 is a graph illustrating relationships between feeding times and feeding speed.

In cases where papers are supplied from the paper cartridge 27 in the plotter 7, the paper supply unit 9 and the paper supply unit 11 positioned at the lowest position, the papers are fed are respectively set in accordance with characteristics A, B and C as shown in FIG. 13. In FIG. 13, a horizontal line indicates a feed time and a vertical line indicates a feed length. It takes a time T for the papers to feed from each paper cartridge to the registration sensor 56. The speed at which the papers are fed is controlled at periods T/6. In a case where papers are supplied from the paper cartridge 27 in the plotter 7, the speed of each of the papers is always controlled at V in accordance with the characteristic A as shown in FIG. 13. In a case where papers are supplied from the paper supply unit 9, the speed of each of papers is controlled, in accordance with the characteristic B as shown in FIG. 13, at V in the first period (T/6), at 2 V in the second period (T/6) and at 3 V in the third period (T/6). After that, the speed of the paper is controlled at 4 V until the paper reaches the registration sensor 56. In a case where papers are supplied from the paper supply unit 11 positioned the lowest position, the speed of each of the papers is controlled, in accordance with the characteristic C as shown in FIG. 13, at V in the first period (T/6) and at 5 V in the second period (T/6). After that, the speed of the paper is controlled at 6 V until the paper reaches the registration sensor 56.

According to the above speed control of the papers fed through the paper feed path, papers can be fed from the paper supply units 8–11 to the registration sensor 56 in a constant time.

The registration sensor 56 mechanically detects the paper as shown in FIGS. 9A and 9B. Thus, in a case where the papers are fed at a high speed, the response speed of the registration sensor 56 is less than the speed at which the papers are fed. In this case, it is difficult to precisely stop the paper at a position at which the registration sensor 56 is mounted. To precisely stop the paper at the position at which the registration sensor 56 is mounted, the speed of the papers is controlled as shown in FIG. 14.

Figure 14:
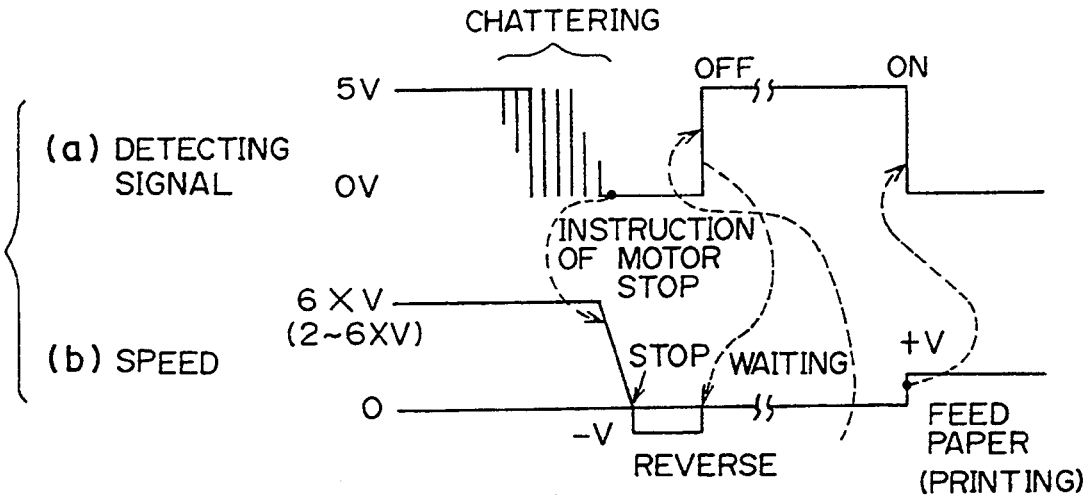
FIG. 14 is a timing chart illustrating a detecting signal output from the registration sensor and a speed control signal in a speed control of a feed motor.

Referring to FIG. 14, when the paper reaches the registration sensor 56, a chattering occurs in the detecting signal output from the registration sensor 56 and then the detecting signal is turned on (0 v), as shown in FIG. 14(*a*). When the detecting signal is turned on, the system controller 2 outputs an instruction for making the feed motor provided in the plotter 7 stop. After the feed motor is made to stop, the feed motor is reversed at a speed V so that a chattering does not occur. Due to the reverse operation of the feed motor, the paper returns until the registration sensor 56 is turned off (+5 v). After that, the paper waits to be fed for a predetermined time, and the feed motor is then normally driven at the speed V. The paper is fed toward the photosensitive medium 22 and images are formed on the paper.

According to the above control of the feed motor, even if the paper is fed to the registration sensor 56 at a high speed, feeding of the paper can be started, from a constant position, toward the photosensitive medium 22 after stopping.

The present invention is not limited to the aforementioned embodiments, and variations and modifications may be made without departing from the scope of the claimed invention.

What is claimed is:

1. An image forming apparatus coupled to a paper supply mechanism formed of a plurality of paper supply units storing papers, said plurality of paper supply units being arranged in a predetermined order along a paper feed path and papers being ejected, one by one, from each of said plurality of paper supply units to said paper feed path, said plurality of paper supply units including at least two paper supply units storing papers having a same size as each other, the papers being fed to said image forming apparatus so that images are formed on the papers, said image forming apparatus comprising:

means for preferentially selecting a paper supply unit located at an upstream position of said paper feed path from among paper supply units storing papers having a same size as each other, such that papers are supplied to said paper feed path from the paper supply unit selected by said means for preferentially selecting;

jam detecting means for detecting whether or not a paper jam has occurred in said paper feed path while papers are being supplied, one by one, from each of said plurality of paper supply units; and paper supply control means for, when said jam detecting means detects that a paper jam has occurred, substituting a a paper supply unit positioned at a position downstream from a position at which the paper jam has occurred for paper supply unit that supplied to said paper feed path the paper that jammed, so that papers are continuously supplied from said substitute paper supply unit to said image forming apparatus via said paper feed path.

2. An image forming apparatus as claimed in claim 1, wherein said paper supply control means selects a supply unit storing papers having a same size as the jammed paper to be said substitute paper supply unit.

3. An image forming apparatus coupled to a paper supply mechanism formed of a plurality of paper supply units storing papers, said plurality of paper supply units being arranged in a predetermined order along a paper feed path and papers being ejected, one by one, from each of said plurality of paper supply Units to said paper feed path, the papers being fed to said image forming apparatus so that images are formed on the papers, said image forming apparatus comprising:

jam detecting means for detecting whether or not a paper jam has occurred in said paper feed path while papers are being supplied, one by one, from each of said plurality of paper supply units: and paper supply control means for, when said jam detecting means detects that a paper jam has occurred, substituting a paper supply unit positioned at a position downstream from a position at which the paper jam has occurred for a paper supply unit that supplied to said paper feed path the paper that jammed, so that papers are continuously supplied from said substitute paper supply unit to said image forming apparatus via said paper feed paths.

the apparatus further comprising means for detecting whether or not each of said plurality of paper supply units is detached from said paper supply mechanism, wherein papers are preferentially supplied from a paper supply unit positioned at a position downstream from the detached paper supply unit detected by said means.

4. An image forming apparatus coupled to a paper supply mechanism formed of a plurality of paper supply units storing papers, said plurality of paper supply units being arranged in a predetermined order along a paper feed path and papers being ejected, one by one, from each of said plurality of paper supply units to said paper feed path, the papers being fed to said image forming apparatus so that images are formed on the papers, said image forming apparatus comprising:

jam detecting means for detecting whether or not a paper jam has occurred in said paper feed path while papers are being supplied, one by one, from each of said plurality of paper supply units; and paper supply control means for, when said jam detecting means detects that a paper jam has occurred, substituting a paper supply unit positioned at a position downstream from a position at which the paper jam has occurred for a paper supply unit that supplied to said paper feed path the paper that jammed, so that papers are continuously supplied from said substitute paper supply unit to said image forming apparatus via said paper feed path;

the apparatus further comprising image storage means for storing image information to be formed on papers when said jam detecting means detects that a paper jam has occurred, the image information being supplied from an external unit, and means for, when the paper jam is removed, changing a paper supply unit supplying papers from said substitute paper supply unit to said paper supply unit that supplied the paper that jammed, so that the papers are then supplied from said paper supply unit that supplied the paper that jammed and the image information stored in said image storage means is formed on the papers.

* * * * *

UNITED STATES PATENT AND TRADEMARK OFFICE

CERTIFICATE OF CORRECTION

PATENT NO. : 5,393,043

DATED : February 28, 1995

INVENTOR(S) : Hiroshi NITTA

It is certified that error appears in the above-indentified patent and that said Letters Patent is hereby corrected as shown below:

On the title page, Item [75], the inventor's name should read:

--Hiroshi Nitta--

Signed and Sealed this

Sixth Day of June, 1995

*Attest:*

Bruce Lehman

BRUCE LEHMAN

*Attesting Officer*

*Commissioner of Patents and Trademarks*